US005437771A

United States Patent [19]

Shimamune et al.

[11] Patent Number: 5,437,771

[45] Date of Patent: Aug. 1, 1995

[54] ELECTROLYTIC CELL AND PROCESSES FOR PRODUCING ALKALI HYDROXIDE AND HYDROGEN PEROXIDE

[75] Inventors: Takayuki Shimamune; Yasuo Nakajima, both of Tokyo; Shuji Nakamatsu, Kanagawa; Yoshinori Nishiki, Kanagawa; Shuhei Wakita, Kanagawa, all of Japan

[73] Assignee: Permelec Electrode Ltd., Kanagawa, Japan

[21] Appl. No.: 196,442

[22] Filed: Feb. 15, 1994

[30] Foreign Application Priority Data

Feb. 26, 1993 [JP] Japan ..... 5-062684
Feb. 26, 1993 [JP] Japan ..... 5-062685

[51] Int. Cl.[6] ..... C25B 1/20; C25B 1/30; C25B 9/00

[52] U.S. Cl. ..... 204/84; 204/98; 204/265; 204/182.4

[58] Field of Search ..... 204/98, 128, 84, 263, 204/265, 182.4, 301; C25B 9/00, 1/30

[56] References Cited

U.S. PATENT DOCUMENTS 3,124,520 3/1964 Juda ..... 204/86
4,357,217 11/1982 Kuehn et al. ..... 204/98

*Primary Examiner*—Kathryn Gorgos
*Attorney, Agent, or Firm*—Sughrue, Mion, Zinn, Macpeak & Seas

[57] ABSTRACT

The electrolytic cell 1 for producing alkali hydroxide or hydrogen peroxide is divided into the anode compartment 3 and the cathode compartment 4 by the cation exchange membrane 2. The cathode compartment 4 is further divided by the anion exchange membrane 6 into the solution compartment 7 containing a concentrated aqueous solution of alkali hydroxide and the gas compartment accommodating the gas cathode 8. The anion exchange membrane 6 prevents the gas cathode 8 from coming into direct or indirect contact with the aqueous solution of alkali hydroxide. This leads to the extended life of the gas cathode. The above-mentioned arrangement is effective in large-sized electrolytic cells. Thus, the present invention can be applied to industrial electrolysis which has never been achieved with the conventional gas electrode.

5 Claims, 2 Drawing Sheets

ELECTROLYTIC CELL AND PROCESSES FOR PRODUCING ALKALI HYDROXIDE AND HYDROGEN PEROXIDE

FIELD OF THE INVENTION

The present invention relates to a process for efficient production of alkali hydroxide by electrolysis of an aqueous solution of alkali chloride. More particularly, the present invention relates to an electrolytic cell and a process for electrolyzing alkali chloride on a large industrial scale with a reduced power consumption.

The present invention also relates to an electrolytic cell and process for efficient production of hydrogen peroxide to be used as an oxidizing agent in many areas.

BACKGROUND OF THE INVENTION

Production of sodium hydroxide and chlorine from brine constitutes an important part of the electrolytic industry. Many improvements have been made on the process and electrolytic cell in this field.

The most advanced industrial process in this field is the ion exchange membrane process. It employs an insoluble anode having an overvoltage as low as tens of mV and an activated cathode having an overvoltage of about 100 mV, between which is interposed an ion exchange membrane whose electric resistance has been owing to recent improvements. Therefore, the electrolytic voltage of this process is about 3 V, which is close to the theoretical value of 2.2–2.4 V. In other words, this process has reached a stage in which there is no room for further improvement in energy saving (except for unavoidable ohmic loss).

The electrolysis of sodium chloride is represented by the following chemical equation.

$$2NaCl+2H_2O \rightarrow 2NaOH+Cl_2+H_2 \quad (1)$$

Although the sodium hydroxide and chlorine gas as the products are fully utilized, the hydrogen as the by-product is not fully utilized at the present time. The electrolytic voltage required for the evolution of hydrogen is theoretically about 0.83 V. This voltage is equivalent to the amount of power consumption that would be saved if an adequate measure is taken to carry out electrolysis without the evolution of hydrogen.

The means developed for this purpose is the oxygen depolarizing electrode (gas electrode), which is based on the principle that if the cathode is supplied with oxygen gas, the cathode reaction proceeds as shown below $$H_2O+2e+1/2O_2 \rightarrow 2OH^- \ (0.40\ V) \quad (2)$$

in place of the conventional reaction represented by $$H_2O+e \rightarrow OH^- + \tfrac{1}{2}H_2 (-0.83V) \quad (3)$$

The theoretical consequence is the saving of electric power equivalent to about 1.2 V.

Hydrogen peroxide is an oxidizing agent used for pulp bleaching, etc. There is an established technique for producing hydrogen peroxide from oxygen or oxygen-containing gas (such as air), also using a gas electrode. Its improvement is still going on, as reported in "Denki Kagaku" (Electrochemistry), 58, 11, 1073, 1989, for example.

The gas cathode itself is known as disclosed in Japanese Patent Publication No. 29757/1990 and Japanese Patent Laid-Open No. 25179/1983. With the gas electrode, it is possible to lower the voltage by about 0.8–1.0 V. It has a hydrophobic porous layer on one side thereof and a hydrophilic layer carrying an electrolytic catalyst on the other side thereof. The catalyst may instead be formed on said hydrophobic porous layer. The catalyst can be electrically conductive carbon carrying platinum thereon, for example.

The gas electrode, however, has the disadvantage that although it works satisfactorily in the initial stage of electrolysis, it loses its catalytic activity in a short period of time because it is in direct contact with concentrated alkali hydroxide (the electrolyte in the production of hydrogen peroxide, for example) during electrolysis. Moreover, it is very difficult to produce a gas electrode of large area which prevents the gas and liquid from penetrating into each other. Therefore, no gas electrode has ever been put to practical use for large-scale industrial electrolysis. Another disadvantage of the gas electrode is that if air is used as the gas, the membrane becomes clogged with sodium carbonate resulting from the reaction of alkali hydroxide with carbon dioxide contained in air. This poses a problem associated with the removal of carbon dioxide from air to be used as the gas.

An idea of providing the gas electrode with an ion exchange membrane, thereby causing it to supply $H^+$ and/or $OH^-$ to the electrolyte compartment, has been proposed in U.S. Pat. No. 3,124,520. Although this idea seems favorable to a large-sized gas electrode, it has never been put to practical use because no details are known about the conditions of actual use.

The above-cited literature describes an electrolytic cell for production of hydrogen peroxide which is divided into an anode compartment, intermediate compartment, and cathode compartment by a cation exchange membrane and anion exchange membrane, with the anode compartment accommodating a gas cathode. A disadvantage of this electrolytic cell is that the gas cathode is not in close contact with the anion exchange membrane and, hence, comes into contact with the catholyte (which is a corrosive aqueous solution of potassium hydroxide). This shortens the life of the gas cathode.

The gas electrode for electrolysis of alkali chloride, on the other hand, is expected to be put to practical use in the near future for the purpose of saving energy. However, it still has a problem associated with its life.

SUMMARY OF THE INVENTION

It is an object of the present invention to provide a large-sized electrolytic cell provided with a long-life gas cathode for electrolysis of alkali chloride and for production of hydrogen peroxide by electrolytic reduction of oxygen.

It is another object of the present invention to provide a process for electrolyzing alkali chloride using said electrolytic cell.

It is a third object of the present invention to provide an electrolytic process for production of hydrogen peroxide by said electrolytic cell.

The present invention is embodied in an electrolytic cell which comprises an anode compartment accommodating an anode and a cathode compartment accommodating a gas cathode, said anode and cathode compartments being separated from each other by a cation exchange membrane, said cathode compartment being divided by an anion exchange membrane into a solution compartment adjacent to said anode compartment and a gas compartment accommodating said gas cathode. The present invention is also embodied in a first process for electrolyzing alkali chloride by the use of an electrolytic cell mentioned above, said process comprising supplying said gas compartment with an oxygen-containing gas and also supplying said anode compartment with an aqueous solution of alkali chloride for electrolysis, thereby forming alkali hydroxide in said solution compartment.

The present invention is also embodied in an electrolytic process for production of hydrogen peroxide by the use of an electrolytic cell defined above, said process comprising performing electrolysis by supplying said anode compartment and solution compartment with water or an aqueous solution of alkali hydroxide and also by supplying said gas compartment with an oxygen-containing gas, thereby producing hydrogen peroxide in said solution compartment. Said anode compartment can be supplied with sodium sulfate instead of alkali hydroxide.

DETAILED DESCRIPTION OF THE INVENTION

Figure 1:
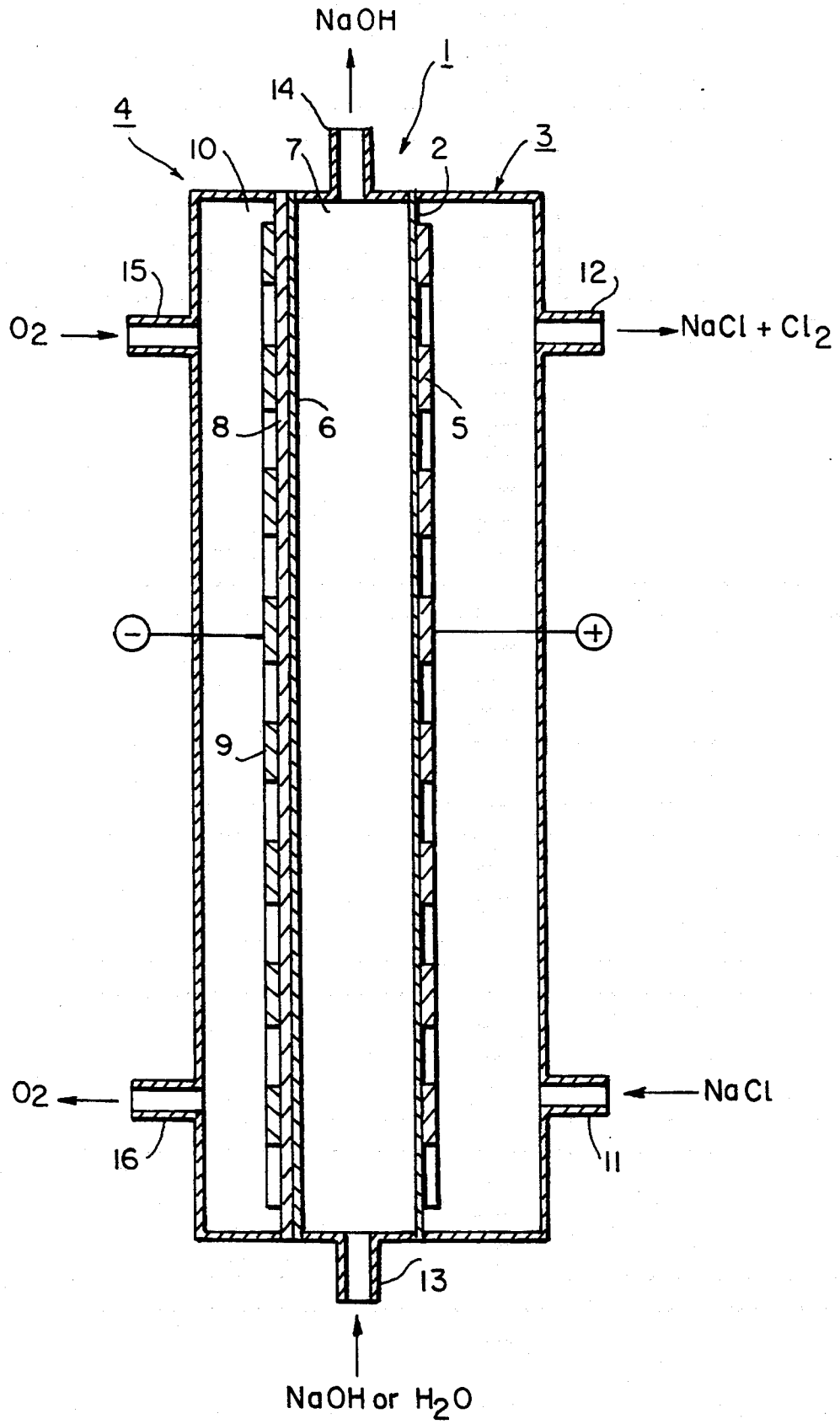
FIG. 1 is a schematic sectional view of an example of the electrolytic cell pertaining to the present invention designed for the production of alkali hydroxide.

One factor that shortens the life of the gas electrode used for electrolysis of alkali chloride seems to be the corrosive action of concentrated alkali hydroxide which wears off the catalyst layer of the gas electrode. According to the present invention, the gas electrode has an extended life because it is not in direct contact with a concentrated aqueous solution of alkali hydroxide. This is accomplished in the present invention because the electrolytic cell is divided into an anode compartment and a cathode compartment by a cation exchange membrane, and the cathode compartment is further divided by an anion exchange membrane into a solution compartment holding an aqueous solution of alkali hydroxide resulting from electrolysis and a gas compartment accommodating the gas electrode.

According to the first process of the present invention, the anode compartment is supplied with an aqueous solution of alkali chloride, the solution compartment is supplied with water or a dilute aqueous solution of alkali hydroxide, and the gas compartment is supplied with oxygen or oxygen-containing gas (such as air). Upon electrolysis, alkali ions in the anode compartment permeate through the cation exchange membrane to reach the solution compartment and hydroxyl ions evolved in the gas compartment permeate through the anion exchange membrane to reach the solution compartment, with the result that alkali hydroxide is formed in the solution compartment. During electrolysis, the anion exchange membrane prevents the permeation of alkali ions of alkali hydroxide from the solution compartment into the gas compartment and permits the permeation of hydroxyl ions (formed on the gas cathode) into the solution compartment. Therefore, hydroxyl ions do not come into contact with the cathode again. The transfer of hydroxyl ions firmly prevents alkali ions from coming into contact with the gas cathode. Thus, the gas cathode is substantially isolated from an aqueous solution of alkali hydroxide. This is the reason why the gas cathode has an extended life.

According to the second process of the present invention, the anode compartment and solution compartment are fed with water or a dilute aqueous solution of alkali hydroxide or sodium sulfate and the gas compartment is fed with oxygen or oxygen-containing gas (such as air). Oxygen is reduced by the gas cathode to give $OH^-$ ions and $HO_2^-$ ions. These ions permeate through the anion exchange membrane to reach the solution compartment, where they react with hydrogen ions ($H^+$) or alkali ions to give hydrogen peroxide or alkali hydrogen peroxide and alkali hydroxide. In this electrolytic process, the anion exchange membrane prevents the permeation of alkali ions (in the alkali hydroxide present and fed to the solution compartment) into the gas compartment, and yet it permits the permeation of $HO_2^-$ ions (formed by the gas cathode) into the solution compartment. It follows that $HO_2^-$ions and alkali ions do not come into contact with the gas cathode. In other words, the gas cathode is substantially isolated from ions contained in the corrosive electrolyte and hence has its life extended.

The electrolytic cell and electrolytic processes of the present invention are advantageous over the conventional system, in which the anode compartment is divided into a solution compartment and a gas compartment by a porous gas cathode. In the present invention, the separation of the two compartments is by an anion exchange membrane which is much more compact than the gas electrode and superior in liquid impermeability. This arrangement firmly prevents the infiltration of an aqueous solution of alkali hydroxide from the solution compartment into the gas compartment. This, in turn, prevents the deterioration of the gas cathode and a decrease of the current efficiency. This technology can be applied to industrial electrolysis to be run with a high current density. In practice, the electrolytic process of the present invention should preferably be carried out with a current density lower than 5 $kA/m^2$ because it tends to result in an increased overvoltage at a high current density. This limitation is due to the fact that the catalyst-gas contact area decrease as electrolysis proceeds, and the mobility of resolution ions is slightly restricted. Thus, the electrolytic cell of the present invention may not function as effectively as a small-sized electrolytic cell such as a fuel cell.

When the electrolytic cell of the present invention is run at a practical current density of 3–4 $kA/m^2$ for the electrolysis of alkali chloride, the electrolytic voltage will be lower than that of the conventional hydrogen evolving cathode by about 0.7 V or about 0.5 V (depending on the performance of the anion exchange membrane) if the cathode compartment is supplied with oxygen or air, respectively.

When electrolysis for production of hydrogen peroxide is carried out at a practical current density of 1 $kA/m^2$, the electrolysis voltage would be lower than that of the conventional process using the hydrogen evolving cathode. The decrease is about 0.9 V if the cathode compartment is supplied with oxygen or about 0.8 V if the cathode compartment is supplied with air (depending on the performance of the anion exchange membrane).

That the membrane becomes clogged due to carbon dioxide contained the feed gas as mentioned above holds true in the present invention. This problem can be solved if the oxygen-containing gas is passed through lime water prior to feeding. A conceivable reason for this is that gas does not come into direct contact with liquid in the hydrophilic layer as in the case of conventional technology.

The anion exchange membrane used in the present invention should be resistant to an approximately 30% hot aqueous solution of alkali hydroxide. A preferred example is a fluorocarbon resin-based ion exchange membrane which is used as the conventional cation exchange membrane. Another example is a hydrocarbon-based ion exchange membrane, which is durable for several months. Presumably, this durability is due to the fact that the surface of the anion exchange membrane is protected by water accompanied by the migrating hydroxyl ions from the cathode (which is characteristic of the gas cathode) and also due to the absence of stirring by bubbles of evolved gas. For continued operation for more than one year, it is necessary to use a fluorocarbon resin-based ion exchange membrane. The anion exchange membrane that can be used in the present invention includes, for example, "Neosepta ACLE-5P" (a product of Tokuyama Soda Co., Ltd.) and "Tosflex IE-SF34" (a product of Tosoh Corporation). The anion exchange membrane may be one which is formed from a particulate anion exchange resin.

The anion exchange membrane prevents the gas cathode from coming into direct contact with an aqueous solution of alkali hydroxide (a possible catholyte used in the production of hydrogen peroxide). It also prevents the aqueous solution of alkali hydroxide in the solution compartment from permeating through the anion exchange membrane to come into contact with the gas cathode. Therefore, it is necessary that the anion exchange membrane have its periphery firmly clamped by the compartment frame of the electrolytic cell so as to prevent the leakage of the liquid. A gas cathode of the solid polymer electrolyte (SPE) type is desirable which permits the close contact between the anion exchange membrane and the gas cathode so as to minimize the liquid resistance between them. Alternatively, they may be placed slightly apart.

The gas cathode (which is placed on that side of the anion exchange membrane which faces the gas compartment) evolves hydroxyl ions by the reaction shown below.

$$H_2O+2e+1/2O_2 \rightarrow 2OH^- \quad (4)$$

The gas cathode evolves hydrogen peroxide ions by the reaction shown in equation (5), when hydrogen peroxide is being produced.

$$H_2O+O_2+2e^- \rightarrow HO_2^- + 2OH^- \quad (5)$$

In either reaction, the ions evolved migrate due to the electric field to the solution compartment through the anion exchange membrane. The gas cathode may or may not be of the SPE type which is in contact with the anion exchange membrane. It should be placed in the gas compartment such that it does not come into contact with the liquid. This eliminates the contact in the liquid phase. Therefore, the gas cathode may be one which is composed of two layers (a hydrophobic layer and a hydrophilic layer) like the conventional gas electrode, or one which has the catalyst embedded in the hydrophobic layer. The gas cathode may be prepared in the same manner as for the conventional gas electrode by mixing a water-repellent resin such as polytetrafluoroethylene (PTFE) with carbon powder carrying a platinum or silver catalyst and then forming the mixture into a sheet. The core may be a carbon cloth or metal mesh. The gas electrode is supplied with electricity through a current collector which is a silver-plated nickel expanded mesh. The current collector is pressed against the gas electrode.

The anode in the anode compartment (which is separated from the solution compartment by the cation exchange membrane) should preferably be a dimensionally stable electrode (DSE) composed of a substrate of valve metal (such as titanium, which is known as a material for the dimensionally stable anode) and a catalyst layer of noble metal oxide.

The above-mentioned cation exchange membrane should preferably be a fluorocarbon resin-based ion exchange membrane which is commonly used for electrolysis of alkali chloride by the ion exchange membrane process. Examples of the ion exchange membrane include "Nafion" (a product of DuPont), "Flemion" (a product of Asahi Glass Co, Ltd.), and "Aciplex F" (a product of Asahi Chemical Industry Co., Ltd.).

The invention will be described with reference to the accompanying drawings.

FIG. 1 is a vertical sectional view showing an example of the electrolytic cell pertaining to the present invention. The electrolytic cell 1 is divided into the anode compartment 3 and the cathode compartment 4 by the cation exchange membrane 2. The anode compartment 3 accommodates the anode 5 (DSE) which is in close contact with the cation exchange membrane 2. The cathode compartment 4 is further divided into the solution compartment 7 and the gas compartment 10 by the anion exchange membrane 6. The solution compartment 7 is adjacent to the anode compartment 3, and the gas compartment 10 accommodates the gas cathode 8 which is in close contact with the anion exchange membrane and also accommodates the current collector 9 (in the form of mesh) through which electricity is supplied to the gas cathode 8.

For the production of alkali hydroxide, the anode compartment 3 is provided with the inlet 11 for brine and the outlet 12 for brine and chlorine gas at the upper and lower parts of the side wall thereof, respectively. The solution compartment 7 is provided with the inlet 13 for a dilute aqueous solution of alkali hydroxide and the outlet 14 for a concentrated aqueous solution of alkali hydroxide at the top and bottom thereof, respectively. The gas compartment 10 is provided with the inlet 15 for oxygen-containing gas and the outlet 16 for oxygen-containing gas at the upper and lower parts of the side wall thereof, respectively.

Figure 2:
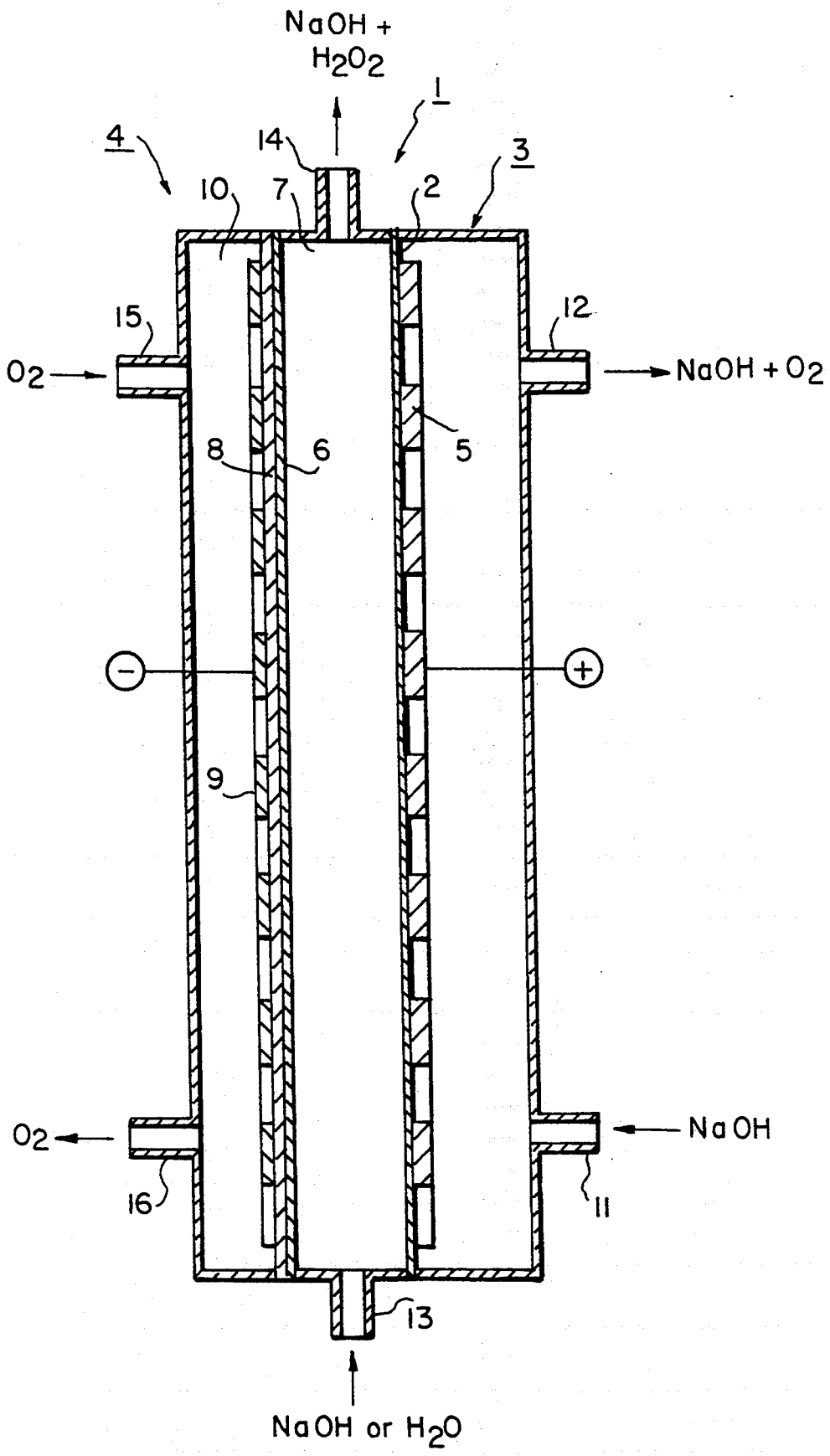
FIG. 2 is a schematic section view of an example of the electrolytic cell pertaining to the present invention designed for the production of hydrogen peroxide.

For the production of hydrogen peroxide, as illustrated in FIG. 2, the anode compartment 3 is provided with the inlet 11 and the outlet 12 for a dilute aqueous solution of alkali hydroxide at the upper and lower parts of the side wall thereof, respectively. The solution compartment 7 is provided with the inlet 13 for a dilute aqueous solution of alkali hydroxide and the outlet 14 for a concentrated aqueous solution of alkali hydroxide at the top and bottom thereof, respectively. The gas compartment 10 is provided with the inlet 15 and the outlet 16 for oxygen-containing gas at the upper and lower parts of the side wall thereof, respectively.

For the production of alkali hydroxide, the anode compartment 3 is fed with brine, the solution compartment 7 is fed with a diluted aqueous solution of alkali hydroxide, and the gas compartment is fed with oxygen-containing gas, and the two electrodes are supplied with electricity. As the result of electrolysis, the anode compartment evolves alkali ions which permeate through the cation exchange membrane 2 to reach the solution compartment 7. Simultaneously, the gas cathode 8 evolves hydroxyl ions which permeate the anion exchange membrane 6 to reach the solution compartment 7. Thus, the alkali ions and hydroxyl ions react with each other in the solution compartment 7 to give alkali hydroxide. The aqueous solution of alkali hydroxide in the solution compartment 7 should preferably be recycled to increase its concentration gradually. However, even though there is a concentrated aqueous solution of alkali hydroxide in the solution compartment 7, it does not adversely affect the life of the gas cathode 8 because the anion exchange membrane 6 (separating the solution compartment 7 and the gas compartment 10 from each other) prevents the concentrated aqueous solution of alkali hydroxide from coming into contact with the gas cathode 8 and also prevents the leakage of the concentrated aqueous solution of alkali hydroxide. Since this principle can be applied to a large-sized electrolytic cell, the illustrated electrolytic cell can be used for electrolysis on an industrial scale.

For the production of hydrogen peroxide, the anode compartment 3 and solution compartment 7 are fed with a dilute aqueous solution of alkali hydroxide and the gas compartment 10 is fed with oxygen-containing gas, and the two electrodes are supplied with electricity. The anode compartment 3 can be also fed with an aqueous solution of sodium sulfate. As the result of electrolysis, the gas cathode 8 evolves hydrogen peroxide ions and hydroxyl ions, which permeate through the anion exchange membrane 6 to reach the solution compartment 7, in which hydrogen peroxide and alkali hydroxide are formed. The oxygen evolved in the anode compartment should preferably be supplied into the gas compartment as the source for oxygen-containing gas.

To further illustrate the invention, and not by way of limitation, the following examples are given.

EXAMPLE 1

A thin carbon fiber cloth was coated with a mixture of fluorocarbon resin, graphite powder, and graphite powder coated with platinum (15 g/m$^2$) by sputtering, and the coating was baked at 250° C. for 30 minutes while it was kept flat under pressure of a weight. In this manner the gas cathode was obtained.

On one side of the gas cathode, there was tightly placed "Tosflex IE-SF34" (a product of Tosoh Corporation) as a fluorocarbon resin-based anion exchange membrane. A current collector (6×3.5 mm expand mesh of silver-plated nickel) was pressed against the other side of the gas cathode. The assembly was installed in an experimental electrolytic cell measuring 50×125 cm.

The anode is a DSE electrode which is a perforated titanium plate, coated with ruthenium-titanium oxide. The cation exchange membrane is "Nafion 90209" (a product of DuPont). It separates the anode compartment and the cathode compartment from each other.

The anolyte is brine (200 g/liter), which is recycled. The catholyte is sodium hydroxide which is recycled about three times per minute, during which it is diluted with pure water to keep its concentration at about 32%.

The cathode gas is oxygen formed by electrolysis of water. It is fed to the gas compartment at a pressure of 30 cmAq after passage through water for humidifying.

Electrolysis was carried out with a current density of 30 A/dm$^2$ at 90° C. It was found that cell voltage was 2.4 V, which is lower by 0.7 V than that (3.1 V) in electrolysis using the ordinary activated cathode.

After continued electrolysis for 6 months, the electrolytic cell showed no sign of deterioration. It was also found that the wear of platinum was only 1 g/m$^2$.

EXAMPLE 2

The same gas electrode as in Example 1 was coated with a mixture of a quaternary ammonium-type anion exchange resin powder and a PTFE dispersion, followed by baking at 120° C. The coating was further coated with PTFE resin containing fine powder of fluorinated graphite, followed by baking. The resulting cathode was used for electrolysis in the same manner as in Example 1. The electrolysis voltage was 2.5 V, higher by 0.1 V than that in Example 1, but lower by 0.6 V than that of conventional electrolysis. After continued electrolysis for 6 months, electrolytic cell showed no sign of deterioration.

For comparison, the same procedure as mentioned above was repeated except that oxygen gas was replaced by air which had passed through lime water. The performance was the same as mentioned above except that the electrolysis voltage increased to 2.7 .V.

COMPARATIVE EXAMPLE 1

Electrolysis was carried out under the same condition as in Example 1, except that the anion exchange membrane was not used, with the gas cathode in direct contact with the aqueous solution of sodium hydroxide. After continued electrolysis for ten days, the solution of sodium hydroxide began to infiltrate into the gas compartment of the gas cathode and the cell voltage began to rise. On the fourteenth day, the cell voltage exceeded 3 V, and hence, electrolysis was discontinued. The electrolytic cell was disassembled and the gas cathode was examined. It was found that the gas cathode was no longer hydrophobic.

EXAMPLE 3

Turning now to hydrogen peroxide production, a mixture was prepared from graphite powder having an average particle diameter of 7 μm (TGP-7, a product of Tokai Carbon Co., Ltd.) and polytetrafluoroethylene dispersion (30J, a product of Mitsui Fluorochemical Co., Ltd.) in a ratio of 2:1 by weight. With the solvent removed by evaporation, the mixture was spread over a titanium plate and pressed between two pieces of titanium plates by rolling to be made into a sheet. The sheet was baked at 350° C. for 10 minutes in air. In this manner a gas electrode was obtained.

On one side the gas electrode, there was placed a nickel expand mesh (0.2 mm thick, 4 mm in major axis, 2 mm in minor axis) as a current collector. On the other side of the gas electrode, there was placed an anion exchange membrane ("ACLE-5P" made of Tokuyama Soda Co., Ltd.). The resulting gas electrode assembly was installed in a cathode compartment of an electrolytic cell of acrylic resin which is divided into an anode compartment and a cathode compartment by a cation exchange membrane ("Nafion 117" made by DuPont in the U.S.). The cathode compartment was divided into a solution compartment (adjacent to the anode compartment) and a gas compartment (accommodating the gas electrode and current collector) by the above-mentioned anion exchange membrane.

The anode compartment was provided with an anode for oxygen evolution (nickel expand mesh, 1 mm thick, 8 mm in major axis, and 3.7 mm in minor axis) which is adjacent to the anion exchange membrane. The anode compartment and solution compartment were filled with a 10% aqueous solution of sodium hydroxide. The gas compartment was fed with excess oxygen equivalent to 10% of oxygen evolved by the anode. Electrolysis was carried out at room temperature at a current density of 10 A/dm$^2$. 2% hydrogen peroxide was evolved in the solution compartment at a cell voltage of 1.6 V. The current efficiency was 80%.

COMPARATIVE EXAMPLE 2

The same electrolytic cell as in Example 3 was constructed except that the anion exchange membrane was not used. Electrolysis was carried out under the same conditions as in Example 1. The cell voltage was 1.2 V; however, 10 minutes after the start of electrolysis, the aqueous solution of sodium hydroxide began to leak from the solution compartment to the gas compartment.

The present invention is embodied in an electrolytic cell which comprises an anode compartment accommodating an anode and a cathode compartment accommodating a gas cathode, said anode and cathode compartments being separated from each other by an anion exchange membrane, said cathode compartment being divided by an anion exchange membrane into a solution compartment adjacent to said anode compartment and a gas compartment accommodating said gas cathode.

The fact that the solution compartment, containing a concentrated corrosive aqueous solution of alkali hydroxide, is separated from the gas compartment (accommodating the gas cathode) by the compact anion exchange membrane prevents the gas cathode (which is poor in corrosion resistance) from coming into direct contact with the corrosive aqueous solution of alkali hydroxide. This leads to the extended life of the gas cathode.

Usually, the larger the electrolytic cell becomes, the more difficult it is to prevent the aqueous solution of alkali hydroxide from infiltrating from the solution compartment into the gas compartment. This is not the case in the present invention. The present invention permits a large-sized electrolytic cell to be run on an industrial scale.

What is claimed is:

1. An electrolytic cell comprising:

an anode compartment accommodating an anode and a cathode compartment accommodating a gas cathode, wherein said anode compartment and said cathode compartment are separated from each other by a cation exchange membrane, and said cathode compartment is divided by an anion exchange membrane into a solution compartment adjacent to said anode compartment and a gas compartment accommodating said gas cathode where the cathode is in direct contact with the anion exchange membrane.

2. A process for electrolyzing alkali chloride by the use of an electrolytic cell composed of an anode compartment accommodating an anode and a cathode compartment accommodating a gas cathode, wherein said anode compartment and said cathode compartment are separated from each other by a cation exchange membrane, and said cathode compartment is divided by an anion exchange membrane into a solution compartment adjacent to said anode compartment and a gas compartment accommodating said gas cathode where the cathode is in direct contact with the anion exchange membrane, said process comprising the steps of:

supplying said gas compartment with an oxygen-containing gas; and supplying said anode compartment with an aqueous solution of alkali chloride for electrolysis, as a result forming alkali hydroxide in said solution compartment.

3. An electrolytic process for production of hydrogen peroxide by the use of an electrolytic cell having an anode compartment accommodating an anode and a cathode compartment accommodating a gas cathode wherein, said two compartments are separated from each other by a cation exchange membrane, and cathode compartment is divided into a solution compartment in contact with the anode compartment and a gas compartment accommodating the gas cathode by an anion exchange membrane in direct contact with the gas cathode, said process comprising the steps of:

supplying said gas compartment with an oxygen-containing gas; and supplying said anode compartment with an aqueous solution of alkali hydroxide, as a result producing hydrogen peroxide in said solution compartment and oxygen in said anode compartment.

4. A process as defined in claim 3, wherein the oxygen evolved in the anode compartment is supplied to the gas compartment as a raw material for hydrogen peroxide.

5. A process as defined in claim 3, wherein said anode compartment is supplied with an aqueous solution of sodium sulfate.

* * * * *

UNITED STATES PATENT AND TRADEMARK OFFICE

CERTIFICATE OF CORRECTION

PATENT NO. : 5,437,771

DATED : August 1, 1995

INVENTOR(S) : Takayuki Shimamune; Yasuo Nakajima; Shuji Nakamatsu; Yoshinori Nishiki, Shuhei Wakita.

It is certified that error appears in the above-identified patent and that said Letters Patent is hereby corrected as shown below:

Title page, item [73], insert -- and De Nora S.p.A., Milano, Italy--.

Signed and Sealed this

Twenty-fourth Day of March, 1998

Bruce Lehman

*Attest:*

BRUCE LEHMAN

*Attesting Officer*

*Commissioner of Patents and Trademarks*